US006953106B2

(12) United States Patent
Weston et al.

(10) Patent No.: US 6,953,106 B2
(45) Date of Patent: Oct. 11, 2005

(54) COLLAPSIBLE SCAFFOLDING TOWER

(76) Inventors: James Thomas Weston, 18 Tomlyns Close, Hutton, Brentwood, Essex (GB), CM13 1PU; Richard Weston, 35 Edmund Road, Rainham, Essex (GB), RM13 8LX ( * ) Notice: Subject to any disclaimer, the term of this patent is extended or adjusted under 35 U.S.C. 154(b) by 36 days.

(21) Appl. No.: 10/479,487

(22) PCT Filed: May 30, 2002

(86) PCT No.: PCT/GB02/02616

§ 371 (c)(1),
(2), (4) Date: Dec. 3, 2003

(87) PCT Pub. No.: WO02/099225

PCT Pub. Date: Dec. 12, 2002

(65) Prior Publication Data

US 2004/0211623 A1 Oct. 28, 2004

(30) Foreign Application Priority Data

Jun. 7, 2001 (GB) ..... 0113861

(51) Int. Cl.[7] ..... E06C 7/16; E04G 7/00
(52) U.S. Cl. ..... 182/115; 182/178.1
(58) Field of Search ..... 182/115, 113, 182/179.1, 178.1, 178.5, 186.7, 186.6, 178.2, 186.9, 222, 223, 152, 116, 117, 118, 119; 135/901; 52/638, 637, 646, 632, 651.1, 651.06

(56) References Cited

U.S. PATENT DOCUMENTS

| | | | | | |
|---|---|---|---|---|---|
| 1,141,919 | A | * | 6/1915 | Auchu | 182/115 |
| 3,454,131 | A | * | 7/1969 | Johnson et al. | 182/115 |
| 3,565,212 | A | * | 2/1971 | Johnson | 182/222 |
| 3,837,427 | A | * | 9/1974 | Mattinson | 182/115 |
| 4,830,144 | A | * | 5/1989 | Werner | 182/178.5 |
| 4,858,726 | A | * | 8/1989 | Preston | 182/152 |
| 5,099,953 | A | * | 3/1992 | Stegath | 182/152 |
| 5,555,954 | A | * | 9/1996 | Swiderski | 182/152 |
| 5,988,317 | A | * | 11/1999 | Riding | 182/152 |
| 6,119,810 | A | * | 9/2000 | Harder | 182/152 |

FOREIGN PATENT DOCUMENTS

| | | |
|---|---|---|
| GB | 988270 | 4/1965 |
| GB | 1 311 569 | 3/1973 |
| GB | 1 498 618 | 1/1978 |
| GB | 2 244 753 | 12/1991 |

* cited by examiner

*Primary Examiner*—Hugh B. Thompson, II
(74) *Attorney, Agent, or Firm*—Jon A. Gibbons; Fleit, Kain, Gibbons, Gutman, Bongini & Bianco P.L.

(57) ABSTRACT

A collapsible scaffolding tower having four uprights arranged in two pairs, wherein each of the uprights is formed of three or more telescopically collapsible sections and rigid horizontal bars extend between the sections of the uprights in each pair to form two telescopically collapsible ladder structures, which rest directly on the ground when the tower is in use.

7 Claims, 3 Drawing Sheets

COLLAPSIBLE SCAFFOLDING TOWER

This application is a 371 of PCT/GB02/02616 filed May 30, 2002.

CROSS-REFERENCE TO RELATED APPLICATIONS

This application is based upon and claims priority from PCT/GB02/02616, filed on May 30, 2002, which is based on and claims priority from British Application 0113861.9 filed on Jun. 7, 2001, the entire disclosure of each of the aforementioned applications are each herein incorporated by reference in their entirety.

1. Field of the Invention

The present invention relates to a collapsible scaffolding tower.

2. Background of the Invention

It is known to form a scaffolding tower from similar rigid frames that are designed to slot into one another. Each frame is formed of tubular steel with two upright poles, or uprights, two horizontal bars and additional struts to maintain the rigidity of the frame. The uprights have different diameters at their upper and lower ends so that the bottom of one frame can be fitted over the top of another. To assemble the tower, two frames are positioned at the sides of the tower, and then frames at the front and rear of the tower are joined to the side frames. The process is then repeated by placing two further frames at the sides of the tower and joining them to the front and rear frames.

When collapsed, such towers are very bulky and when erected they are rickety because they rely on a good fit between the individual frames to give the tower its rigidity.

GB 1,311,569, shows collapsible scaffolding made up folding sections that slot into one another. The scaffolding when collapsed consists of several separate sections and is not therefore very compact nor easy to transport.

GB 988,270 discloses an extension frame having telescopically collapsible legs. However, the extension frame needs to rest on the base frame, not on the ground, and it provides only one extendible section. GB 988,270 also shows a complex collapsible scaffolding that is formed of a base frame, an extension frame and various bracing elements. Once again, the use of separate frames makes the structure bulky when collapsed.

WO95/027836 discloses a scaffolding which without being dismantled can be reduced in height to one tenth of its operational height for storage and transportation. The scaffolding has platforms with hinged uprights that can be folded to a horizontal position beneath the platforms in a concertina-like manner. The scaffolding cannot be erected simply and indeed this operation requires a separate hoist or crane.

Accordingly, what is needed is to overcome the shortcomings of the prior art and to provide a scaffolding tower that is compact when collapsed, that is easy to erect and that is sturdy when assembled.

SUMMARY OF THE INVENTION

According to the present invention, there is provided a collapsible scaffolding tower having four uprights arranged in two pairs, wherein each of the uprights is formed of three or more telescopically collapsible sections and a respective rigid horizontal bar extends between each pair of sections of the uprights to form two telescopically collapsible ladder structures which rest directly on the ground when the tower is in use and wherein a support platform is provided having opposite ends each removably resting on a rigid horizontal bar of a respective one of the two ladder structures.

While it would be possible to interconnect two collapsible ladder structures using detachable cross members to form a rigid tower, such a tower would need at least two people to assemble it. To permit single-handed assembly, it is preferred for the lowermost sections of the two collapsible ladder structures to be permanently connected to one another by a folding or collapsible structure that allows the two ladder structures to move towards and away from one another while remaining essentially parallel to one another.

Such a collapsible structure may comprise a lazy tongues or trellis-like system of pivoted bars to connect the ladder structures to one another, but it is preferred to use a folded gate formed of two leaves which are pivoted about vertical axes to one another and to respective ones of the sections of the uprights of the two ladder structures.

BRIEF DESCRIPTION OF THE DRAWINGS

The invention will now be described further, by way of example, with reference to the accompanying drawings, in which.

DETAILED DESCRIPTION OF THE PREFERRED EMBODIMENT

Figure 1:
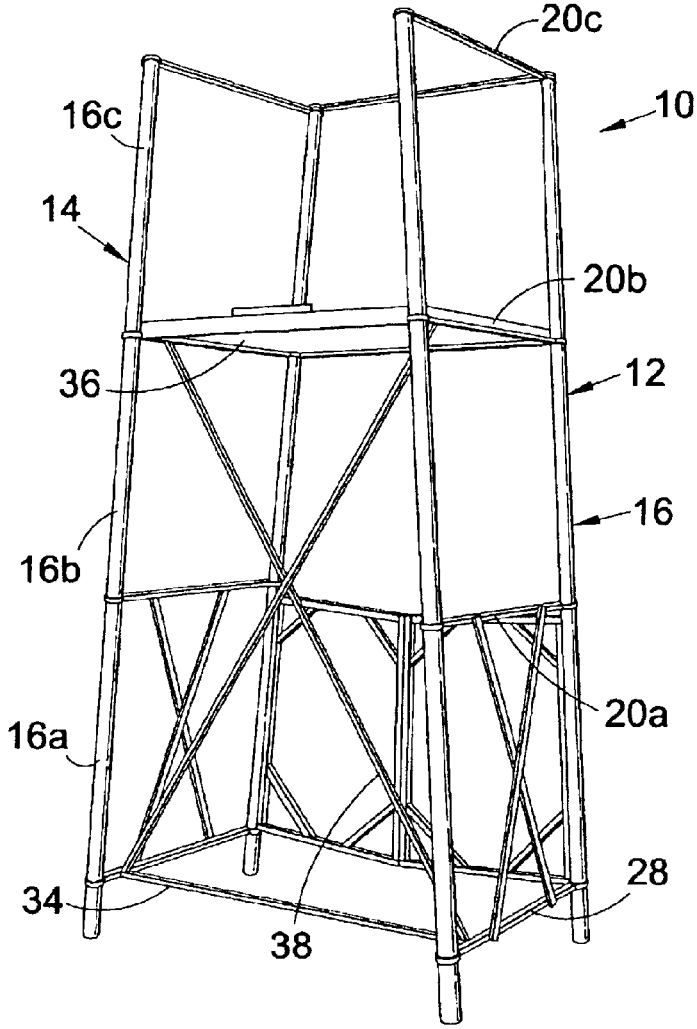
FIG. 1 is a perspective view of a first embodiment of the invention in its extended position.

FIG. 1 shows a scaffolding tower 10, two opposing sides of which each consist of a telescopic ladder structure 12 and 14. The remaining opposing sides of the tower are formed by a collapsible gate 18 (see FIG. 2) and a cross brace 34. The rungs 20*b* of the telescopic ladder structures 12, 14 support a platform 36 similar to those which can be found on conventional scaffolding towers.

The telescopic ladder structures 12, 14 have stiles 16 formed of telescopically collapsible tubular sections 16*a*, 16*b* and 16*c*. Each section supports a rung 20*a*, 20*b* and 20*c*. When extended, the tubular sections lock into each other, by means of spring-loaded pins (not shown), thereby preventing the stiles 16 from collapsing when in use. Further security can be attained by providing an additional pin, which can be manually inserted in a hole through any two aligned telescoping sections 16*a*, 16*b* or 16*c*. When collapsed, the three rungs 20*a*, 20*b* and 20*c* lie adjacent one another. This allows the sides of the tower when extended to be approximately three times their collapsed height.

Figure 2:
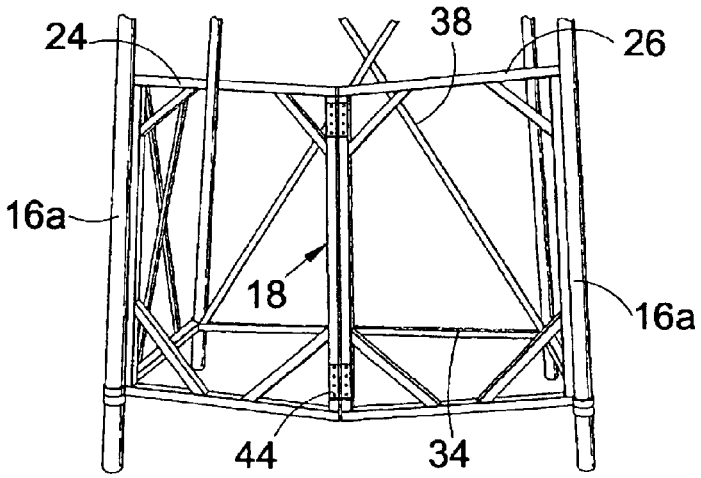
FIG. 2 shows a front view of a gate structure of the preferred embodiment when in the extended position.

FIG. 2 shows the third side of the tower which is formed by joining the two opposing ladder structures to each other on one side by a gate 18 having two gate leaves 24 and 26.

The gate leaves 24, 26 are formed from an open frame, and hinged to each other about a vertical axis. The remaining vertical edges of the gate 18 are hingedly attached to the lowest section 16*a* of the telescopic stile 16 of the respective ladder structure. This arrangement positions both ladder structure ends of the tower approximately upright enabling construction to be carried out by one person.

In the preferred embodiment, the leaves of the gate are symmetrical about the hinge 44 joining them and trapezium in shape. As a result, the ladder structures do not lie exactly parallel to one another but form a more sturdy A-frame. The hinges still allow the leaves to fold inwards when collapsed, about the centre hinge 44.

A support bar 28 is positioned just above the foot of each ladder structure between its stiles 16, in line with the lower edge of the collapsible gate 18, thereby adding to the rigidity of the structure. Rigidity is still further increased by the provision of bracing rods 30 and 32 which extend diagonally between the support bar 28 and rung 20*a* on each ladder structure. The tensioned crossed arrangement resists racking in either direction.

The fourth and final side of the tower 10 is formed by the insertion of a cross brace 34 parallel to the gate 18 spanning either between the vertical stiles 16 of the ladder structures 12,14 or between the support rungs 28. The cross brace 34 is secured to either of these using conventional methods such as threaded clamps.

This completes the first level of the tower 10. The second and third rungs 20*b* and 20*c* of telescopic ladder structures 12,14 define the second and third levels when the ladder structures are extended to full height. Platform 36 for providing a support floor for a user of the tower, is supported on rung 20*b* and locked thereto using suitable means. This will further increase structural rigidity of the tower.

Figure 3:
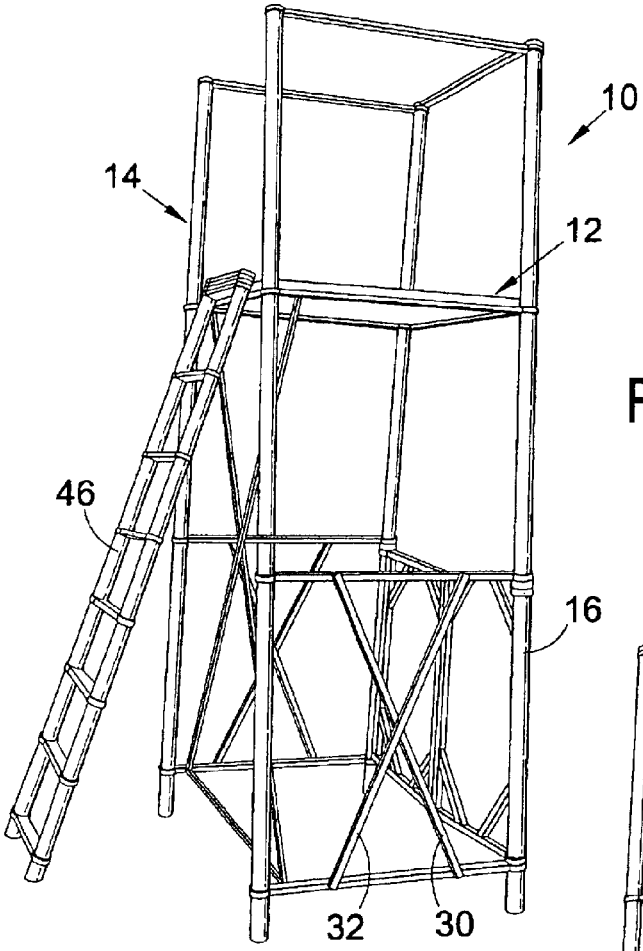
FIG. 3 shows a side view of a first embodiment when attached to a ladder.
Figure 4:
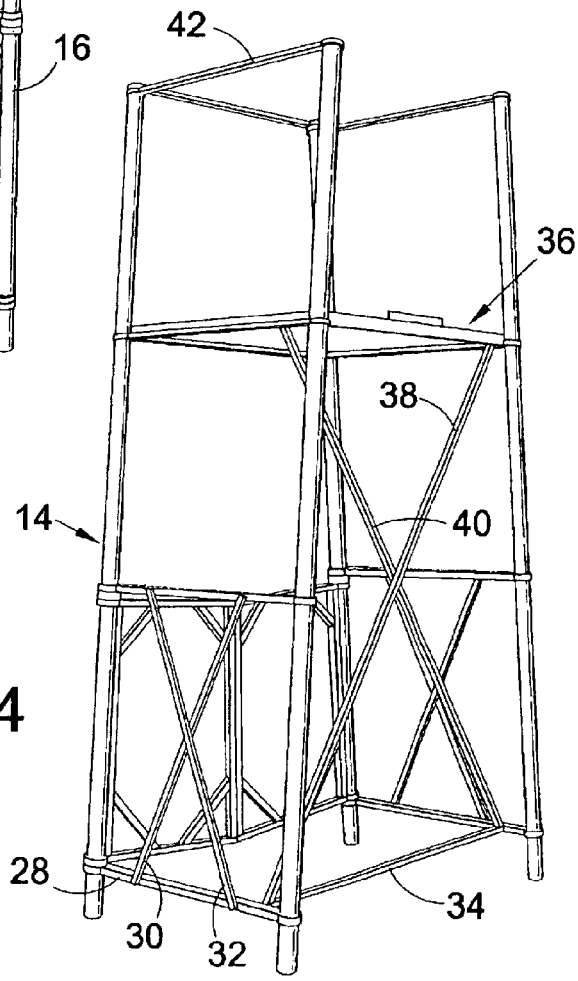
FIG. 4 shows an alternative perspective view to that of FIG. 1.

FIG. 3 shows a ladder 46 secured to the tower to allow easy access to the platform. The ladder 46 may itself be collapsible for ease of transportation. To aid with assembly, a ladder 46 may be secured to either of rungs 20*a*. This provides stability whilst enabling the user to reach high enough to insert the platform boards.

Though the A-frame structure is not prone to racking, its rigidity is improved further by the inclusion of telescopic tension rods 38 and 40. These are similar in function to bracing rods 30 and 32. The telescopic nature of the rods 38 and 40, allows them to also retract in a direction required for the tower 10 to collapse when not in use. This feature is not a requirement of bracing rods 30 and 32 since they span a distance which remains constant regardless of the configuration of the tower. The telescopic tension rods 38 and 40 diagonally span from support bar 28 of one ladder structure to rung 20*b* of the opposing ladder structure. The telescopic tension rods 38, 40 can employ spring loaded locking pins, similar to those used in the telescopic stiles 16 of the ladder structures 12, 14. These would give the rods strength in both tension and compression but would make the tower more difficult to collapse. In place of pins, one could use spring biased pawl-like members to prevent the rods from being extended without interfering with their collapse. It should be noted that for the tower to be totally collapsible, the telescopic tensioning rods 38, 40 must each comprise at least two sections. Alternatively, the telescopic tension rods 38, 40 may be replaced with fixed support rods which would require attachment each time the tower is erected.

For safety as well as rigidity, a support bar 42, is secured between rungs 20*c* of the opposing ladder structures 12, 14. This completes the erected tower but further reinforcements can be employed.

For the purposes of collapsing the tower 10, support bar 42, platform 36 and cross brace 34 must all be removed. It is then necessary to retract the telescopic stiles 16, by releasing the spring loaded pins and pulling the upper rungs 20*b* and 20*c* in a downwards direction.

At this stage the partially collapsed tower appears similar to a child's play pen. The final stage of collapsing requires that the collapsible gate 18 is bent about its hinge 24, towards the now partially retracted telescopic tension rods 38, 40. When viewed from above, the tower at this point would appear M-shaped. The gate 18 is then fully folded and the ladder structures 12, 14 brought together, at the same time the telescopic tension rods will be in their fully retracted position. This final position is very space efficient and makes for ease of storage and transportation.

Figure 5:
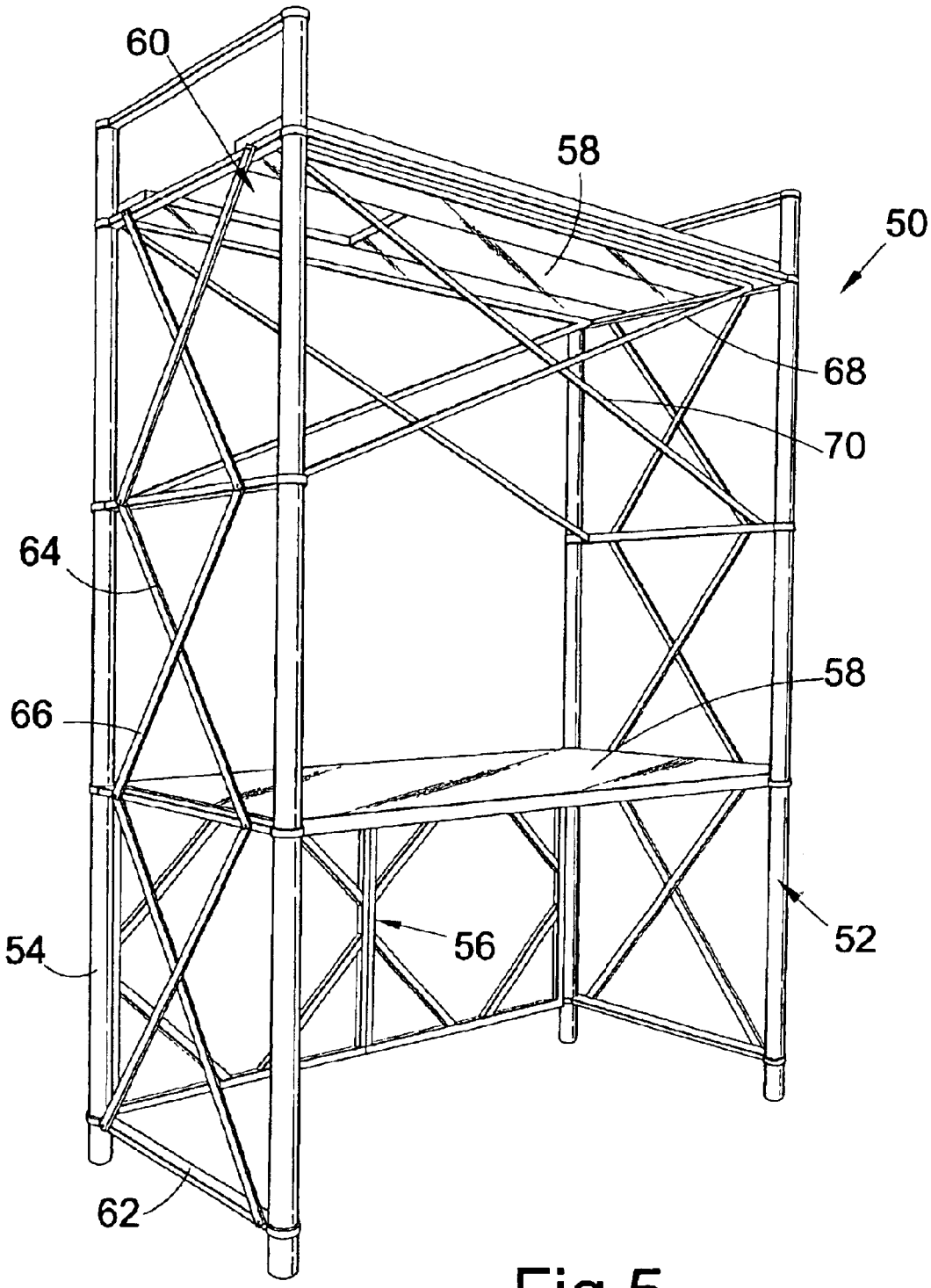
FIG. 5 shows a perspective view of a second embodiment of the present invention when in its extended position.

FIG. 5 shows a second embodiment intended for use primarily as a conventional scaffolding tower again with the advantage that it may be collapsed and easily erected by one person.

Tower 50 is similar in construction to the previous embodiment, the main difference being that the ladder structures which form the sides of the tower 50 are parallel. To aid in construction the present embodiment uses a collapsible gate 56 similar to that described with reference to the previous embodiment.

The second embodiment further differs by employing two platforms 58. These may have a cut-out 60 formed therein, enabling a ladder to be placed between the platforms to allow ascent on to the upper level.

The embodiment of FIG. 5 also employs support rungs 62 similar to support rungs 28. Racking in two directions is reduced by telescopic braces 64 and 66 which are attached between each of the rungs of the telescopic ladder structures 52 and 54. The braces 64 and 66 are formed of telescoped sections that can collapse one inside the other but a catch or other abutment prevents their extension beyond a certain point. Because they cannot be extended beyond a certain point, they act in the same way as taut wires to prevent racking but because they can be collapsed they do not interfere with the collapsing of the scaffolding.

Racking in the direction parallel to the width of the tower is further reduced by longer telescopic braces 68 and 70 which stretch between the rungs of adjacent levels of the opposing ladder structures. These may be replaced by rigid removable braces, but this arrangement would not be as easily erected or collapsed.

What is claimed is:

1. A collapsible scaffolding tower comprising:

four uprights arranged in two pairs, wherein each of the uprights is formed of at least three telescopically collapsible tubular sections; and at least one rigid horizontal bar extending between each of the pairs of sections of the uprights to form two telescopically collapsible ladder structures that rest directly on the ground when a tower is in use, wherein a support platform is provided having opposite ends each removably resting on a rigid horizontal bar of a respective one of the two ladder structures, wherein the two ladder structures are permanently connected to one another by at least one of a folding and a collapsible structure that allows the two ladder structures to move towards and away from one another while remaining essentially parallel to one another relative to one another at small acute angle so as to form the tower that is narrower.

2. The collapsible scaffolding tower of claim 1, wherein the two ladder structures are connected a folded gate having two leaves that are pivoted about vertical axes to one another and to respective sections of the uprights of the two ladder structures.

3. The collapsible scaffolding tower of claim 1, further comprising:

one or more collapsible braces that extend between the two ladder structures and between the uprights of each of the two ladder structures in order to prevent racking of the tower.

4. The collapsible tower of claim 1, wherein the two ladder structures are inclined relative to one another at small acute angles so as to form the tower that is narrower at a top of the tower as compared with a bottom of the tower.

5. A collapsible scaffolding tower comprising:

four uprights arranged in two pairs, each upright including a plurality of telescopically collapsible tubular sections that are collapsible telescopically into one another; and rungs extending between the uprights of each pair, each rung having opposite ends, one end being connected to a section of one of the two uprights and the other end being connected to a corresponding section of the other of the two uprights of each pair, to form two telescopically collapsible ladder structures that rest directly on the ground when the tower is in use, wherein the two ladder structures are permanently connected to one another by at least one of a folding and a collapsible structure that allows the two ladder structures to move towards and away from one another while remaining essentially parallel to one another.

6. The collapsible scaffolding tower of claim 5, including a platform having opposite ends, one end removably resting on a rung of one of the telescopically collapsible ladder structures, the other end removably resting on a rung of the other of the telescopically collapsible ladder structures.

7. The collapsible tower of claim 5, wherein each of the telescopically collapsible ladder structures is inclined relative to the other telescopically collapsible ladder structure such that the tower is narrower at a top of the tower than at a bottom of the tower.

* * * * *